US009505515B2

(12) United States Patent
Vistrom et al.

(10) Patent No.: US 9,505,515 B2
(45) Date of Patent: Nov. 29, 2016

(54) PACKAGING CONSTRUCTION AND METHOD FOR MANUFACTURING SAID PACKAGING CONSTRUCTION

(75) Inventors: Magnus Vistrom, Sundsvall (SE); Rickard Hagglund, Sundsvall (SE); Folke Osterberg, Sundsvall (SE)

(73) Assignee: SCA FOREST PRODUCTS AB, Sundsvall (SE)

( * ) Notice: Subject to any disclaimer, the term of this patent is extended or adjusted under 35 U.S.C. 154(b) by 0 days.

(21) Appl. No.: 14/386,086

(22) PCT Filed: Mar. 22, 2012

(86) PCT No.: PCT/SE2012/050321
§ 371 (c)(1),
(2), (4) Date: Sep. 18, 2014

(87) PCT Pub. No.: WO2013/141769
PCT Pub. Date: Sep. 26, 2013

(65) Prior Publication Data

US 2015/0048152 A1 Feb. 19, 2015

(51) Int. Cl.
*B65D 5/20* (2006.01)
*B65D 5/56* (2006.01)
(Continued)

(52) U.S. Cl.
CPC ..... *B65D 5/2038* (2013.01); *B31F 1/20* (2013.01); *B65D 3/22* (2013.01); *B65D 5/0209* (2013.01); *B65D 5/563* (2013.01); *B65D 5/566* (2013.01); *B65D 5/6602* (2013.01); *B65D 65/403* (2013.01)

(58) Field of Classification Search
CPC ..... B65F 5/2038; B65F 5/563; B65F 5/566; B65F 5/6602; B65F 5/0209; B65F 5/029; B65F 3/04; B31F 1/20; B32B 29/08
USPC ..... 229/182.1, 5.81, 4.5, 90, 940; 493/110
See application file for complete search history.

(56) References Cited

U.S. PATENT DOCUMENTS 2,027,586 A 1/1936 George
3,410,473 A 11/1968 Petrie
(Continued)

FOREIGN PATENT DOCUMENTS

BE 777631 A7 4/1972
CN 201338420 Y 11/2009
(Continued)

OTHER PUBLICATIONS

English language translation of a Notice of Reasons for Rejection issued Sep. 28, 2015 in corresponding Japanese Patent Application No. 2015-501618 (7 pages).
(Continued)

*Primary Examiner* — Christopher Demeree
(74) *Attorney, Agent, or Firm* — Drinker Biddle & Reath LLP

(57) ABSTRACT

A packaging construction being formed by multi-layer board material includes a middle layer, a first outer layer attached to the middle layer and a second outer layer attached to the middle layer. The packaging construction defines a bottom side, a top side, and a plurality of side panels joining the bottom side and the top side so as to form a closed structure. At least one edge is defined between adjacent side panels. The packaging construction is arranged so that the second outer layer has a lower bending stiffness according to ISO 5628 than the first outer layer such that the board is outwardly bendable only in a direction towards which the second layer faces, and in that the packaging construction is formed with at least one side panel being curved and/or at least one edge being rounded.

23 Claims, 8 Drawing Sheets

(51) Int. Cl.

| | |
|---|---|
| ***B65D 5/66*** | (2006.01) |
| ***B31F 1/20*** | (2006.01) |
| ***B65D 65/40*** | (2006.01) |
| ***B65D 3/22*** | (2006.01) |
| ***B65D 5/02*** | (2006.01) |

(56) References Cited

U.S. PATENT DOCUMENTS

| | | | | |
|---|---|---|---|---|
| 4,286,006 | A * | 8/1981 | Boelter | B32B 3/28 428/182 |
| 5,205,473 | A | 4/1993 | Coffin, Sr. | |
| 2005/0199692 | A1 * | 9/2005 | Nelson | B65D 5/10 229/182.1 |
| 2006/0165960 | A1 | 7/2006 | Rydberg | |
| 2008/0268213 | A1 | 10/2008 | Ohanesian | |
| 2014/0162030 | A1 | 6/2014 | Vistrom et al. | |

FOREIGN PATENT DOCUMENTS

| | | | |
|---|---|---|---|
| CN | 201833641 | U | 5/2011 |
| DE | 4341129 | A1 | 6/1995 |
| GB | 2427399 | A | 12/2006 |
| JP | S50-118239 | U | 9/1975 |
| JP | S53-30431 | U | 3/1978 |
| JP | 3006889 | U | 1/1995 |
| JP | 2008-201423 | | 9/2008 |
| JP | 3160065 | | 5/2010 |
| JP | 2014-524856 | | 9/2014 |
| WO | WO-2011/075046 | A1 | 12/2006 |

OTHER PUBLICATIONS

Pope, "The buckling behavior in axial compression of slightly-curved panels, including the effect of shear deformability", Int. J. Solids Struct. 4, 1968, pp. 323-340.

Partial English translation of a Chinese Office Action issued in corresponding Chinese patent application No. 201280073359.0 (2 pages).

English language translation of a Decision of Rejection dated Jun. 20, 2016 issued in corresponding Japanese patent application No. 2015-501618 (6 pages).

* cited by examiner

PACKAGING CONSTRUCTION AND METHOD FOR MANUFACTURING SAID PACKAGING CONSTRUCTION

CROSS-REFERENCE TO PRIOR APPLICATION

This application is a §371 National Stage Application of PCT International Application No. PCT/SE2012/050321 filed Mar. 22, 2012, which is incorporated herein in its entirety.

TECHNICAL FIELD

The present disclosure relates to a packaging construction being formed by multi-layer board material including a middle layer, a first outer layer attached to the middle layer and a second outer layer attached to the middle layer, said packaging construction defining a bottom side, a top side, and a plurality of side panels joining said bottom side and said top side so as to form a closed structure, wherein at least one edge is defined between adjacent side panels, The present disclosure also relates to a method for manufacturing a packaging construction.

BACKGROUND

There is today a desire for packages, boxes and enclosures to be designed in a unique manner and having designs which are arranged so as to attract customers, for example in the form of developing eye-catching packages for point of sales. Examples of such packages are cylindrically or elliptically shaped packages or packages having rounded sides or edges.

Presently, packaging constructions may be fabricated by carton board or various types of corrugated board. The problem with these materials is that they do not allow for packagings that are curved without encountering issues. For example, packages made of carton board or double faced corrugated board are rarely seen with rounded edges because high grammage carton board and double faced corrugated board will deform if bent to a too small radius. Carton board can be bent to some extent, but is deficient in stability compared to double faced corrugated board. Carton board does not provide the cushioning feature that a corrugated board provides.

Carton board and single faced corrugated board are deficient in stability. Because of the lack of stability, single faced corrugated board is not suitable for converting operations.

It is possible to bend corrugated board to a small extent, but the resulting tension in the board implies a risk for kinks whenever it is handled in a way which would bend it slightly more. Some of today's corrugated board may be bent into curved forms having a radius of about 400-440 mm when bent perpendicularly to the corrugated pipes.

Single faced corrugated board can be bent into a small radius, but because of the lack of stability, single faced corrugated board is not suitable for converting operations. Without having an inner lining, the performance of a box made of such material will be low (e.g. stacking strength and performance in transport). Furthermore, single faced corrugated board only has one flat side suitable for printing. The corrugated layer of the single faced corrugated board is not very representative as the outside or as the inside of a package.

Packaging that should withstand loads induced in transport, transhipment and handling need certain performance requirements. For storage and transport, it is important to have a sufficient stacking strength and a sufficient strength and stability with respect to transport related loads. A packaging's ability to withstand transport loads is here referred to as stability in transit. Furthermore, to protect the contents of the package from mechanical shocks, it is often important that the package is providing a cushioning feature. Stacking strength can be measured by a BCT test (Box compression test—ISO12048) and gives a measure of how much load the package can take on top of itself before the side panels start to deform. The level of the packages' stability in transit is possible to test in a lab environment and is also possible to test for example by loading a lorry with packages and thereafter driving around for a certain time having moments of acceleration and decelerations.

It is known in prior art that it is possible, for example by using additional material, to reinforce the edges of a package in order to increase the BCT level. The edges are specifically in target for reinforcement since they are carrying most of the load when packages are stacked on top of each other. However, this kind of reinforcement is leading to an increased usage of material which implies a higher cost and heavier packages, which in the end may have an affect on profitability and the environment. Furthermore, the prior art solutions do not provide any good solution for providing curved shapes to fulfil the desire to introduce new curved shaped packages (e.g. rounded side panels or curved edges between side panels) in order to attract consumers, e.g. in the point of purchase situation.

For example, there are a number of known types of packages, for example so-called bliss containers, which are provided with reinforced corners in order to take high compressive loads, i.e. the container will get a higher stacking strength.

Cylindrical tube shaped paper packages exist, but these packages cannot be delivered as flat blanks, which means that the transportation of these packages is inefficient. With respect to recycling, cylindrical tubes may also be difficult to handle for a consumer once the content is consumed since they cannot be folded without damaging the material.

There is thus a need for an improved and visually attractive packaging construction that may constitute a cylindrically shaped package, a package with curved side panels or with rounded edges between adjacent side panels which can be transported as a flat blank. There is also a need for a packaging construction that minimises the use of material but still provides a high level of BCT and stability in transit.

SUMMARY

It is desired to provide a package construction with curved side panels or rounded edges between adjacent side panels, which has a light weight in relation to the level of BCT and stability in transit and an attractive form to catch the attention of consumers (e.g. in the point of purchase situation).

Additionally, it is desired to provide a package construction with curved side panels or rounded edges between adjacent side panels that can be transported as a flat blank.

Disclosed herein is a packaging construction as initially mentioned, in which the second outer layer has a lower bending stiffness according to ISO 5628 than the first outer layer such that said board is outwardly bendable only in a direction towards which the second layer faces, and in that said packaging construction is formed with at least one side panel being curved and/or at least one edge being rounded.

The term "smoothly bendable", or simply "bendable", refers in this context to a physical shape of the board material which presents a continuous, generally even and regular curved shape, generally without any irregularities, folds or interruptions in the curvature.

Curved side panels of a package have an advantage compared to straight panels with respect to BCT and stability in transit. This is due to fundamental structural principles implying that curved panels are relatively more resistant to buckling compared to flat and because of that curved panels provide a higher relative strength compared to structures consisting of flat panels. In this regard, reference is made to the publication "The buckling behaviour in axial compression of slightly-curved panels, including the effect of shear deformability", Int. J. Solids Struct. 4 (1968), pp.; G. G. Pope.

A curved shaped panel is beneficial in top-to-bottom loading but also in horizontal shear which relates to stability in transit. A package having for example a cylindrical shape or an oval shape would accordingly provide a high BCT value and perform well in transport testing.

Furthermore, curved panels or rounded edges prevents the packaging construction to twist, which improves handling aspects.

There is provided an improved packaging construction by means of which the need for packages having aesthetically appealling designs can be provided, i.e. packages having for example circular or oval form, or practically any form involving rounded edges and/or curved side panels. Provided is an improved relationship of the strength and the weight of the packaging. For example, by introducing curved edges between adjacent side panels, it is possible to keep a high grammage outer layer to provide a high quality print surface and minimize the grammage of the inner layer while still keeping the stacking strength.

One possible way to introduce curved side panels, would be to introduce concave side panels giving the package the shape of the symbol of the diamond in a deck of playing cards. In the case of such a design, it is important to note that the top and bottom sides need to be provided as separate parts which need to be glued so as to form the complete packaging.

A circular shape might not be the most optimal package with respect to external filling degree. External filling degree relates to what degree e.g. trucks or containers are filled with goods, packaging or finished products. A similar limitation exists with regard to the internal filling degree. The internal filling degree relates to how much of the inside space of a package that is filled with a product content. The internal filling degree depends on the format of the product that should fit into the package. For a package with a circular cross-section, there will be a non-optimal internal filling degree for products having a square cross-section.

Since it is the corners that are taking up most of the load, a compromise, to get a good filling degree, would be to introduce curved shaped edges. Compared with co-packed circular shaped packages, co-packed square shaped packages with rounded edges result in less unutilised space.

A characteristic of embodiments disclosed herein is that empty packages can be transported as flat blanks, which means that the external filling degree would be high, thus resulting in cost efficient transportation of non filled packages (i.e. the transport of empty packages from a plant for producing the packages to a product producer who is filling the packages with its contents. Even if the manufacturing joints of the packages are sealed, it is possible to transport them as flat blanks.

A package construction can furthermore be folded in a suitable manner so as allow for efficient transport when a number of blanks should be shipped. Due to the fact that the material for a package may be bent, the score from such foldings will be very limited (or even invisible) once the package is unfolded, i.e. erected, in order to assume its intended shape. This is particularly the case when the fold is made on a plane side panel of the packaging construction (see FIG. 6 below) as opposed for example to a circular or oval side panel.

The score from the folding (to make it flat) will not, or only marginally, affect the BCT value since the marking lines are in the same vertical direction as the force that comes from loading packages on top of each other.

New packaging patterns where circular packages containing products are co-packed with diamond shaped packaging could be used to optimise external filling degree in transportation.

In order to provide curved shaped panels or rounded edges between adjacent side panels there is a need for a bendable material, e.g. a smoothly bendable board. Such a material will be described in detail below. When referring to bending stiffness, measurements of the bending stiffness are made according to ISO 5628.

The term "smoothly bendable" is defined as a material's ability to bend according to a smooth and continuous radius, in this case the ability of the first outer layer to bend according to a smooth and continuous radius. After bending of the first outer layer, the first outer layer should not display any irregularities such as for instance kinks. Instead, the final rounded or curved shape of the first outer layer of the package should have a continuous and even appearance without any folds or non-curved sections along the curvature.

Some of today's corrugated board can be bent into curved forms having a radius of about 400-440 mm when bent perpendicular to the corrugated pipes. Using this material, besides not reaching a smaller radius than about 400 mm, there are several other problems associated with bending today's corrugated board perpendicular to the corrugated pipes. Since quite a lot of force is required to bend the material; it is easy for kinks to occur when approaching a radius of 400 mm. To create a circular form having this radius a sheet of corrugated board with a length of 2760 mm excluding any needed overlap is required. This sheet size is not available today.

Because of the stiffness of the corrugated board, it is also difficult to join the ends of the material in a way that will result in an acceptable circular form. Another problem with respect to bending the material perpendicular to the corrugated pipes is that the material will get a lower bending stiffness in the vertical upright direction. Hence, the maximum load of a certain package construction can carry will be quite limited. If the corrugated board instead would be bent along the corrugated pipes the radius needs to be about 3-4 times bigger to avoid kinks.

Certain embodiments makes use of a smoothly bendable board where the middle layer is corrugated, i.e. it comprises flutes. However, the description for the outer layers is valid for the cases where the middle layer includes a different material than flutes such as for instance a thermoformed core.

One condition to get a smooth and continuous radius is that the second outer layer should buckle between each peak of the corrugated middle layer when the material is subjected to bending in the bendable direction. When each section of the second outer layer exhibit buckling, the bending can be distributed across each section of the material. The above can theoretically be described by Euler's 4 th case of buckling, $$Pk = \frac{4\pi^2 EI}{\lambda^2}, \quad \text{(Equation 1)}$$

where

Pk=the buckling force, i.e. the force that corresponds to when the material starts to buckle, EI=the material's bending stiffness and λ=the length between two peaks of the corrugated middle layer, i.e. the length between attachment points of the flutes to the second outer layer.

When the smoothly bendable board mentioned above is exposed to bending the material in the second outer layer will start to buckle between the tops of the corrugated middle layer if the bending stiffness of the second outer layer is low enough.

If the bending stiffness of the second outer layer is too high, the second outer layer will instead break, i.e. get a kink, when the applied force Pk has reached the material's compression strength according to the short-span compressive test according to ISO 9895, hereinafter referred to as SCT. In the case of a too high bending stiffness of the second outer layer, the second outer layer will not be subject to buckling, and therefore the material will not necessarily bend according to a smooth and continuous radius.

If the bending stiffness of the first outer layer is high enough even though the second outer layer is not subject to buckling, it may still be possible to bend the material into a more or less accurate curve form. However, the result will not be as good as if the second outer layer has been subject to buckling.

In order to get the sections of the second outer layer to exhibit buckling, the compression strength (SCT) of the second outer layer should be higher than the buckling Pk (measured in N/m), i.e. Pk<SCT.

Using this inequality and rearranging equation 1, we get $$EI_{second\ outer\ layer} < \frac{SCT \cdot \lambda^2}{4\pi^2}, \quad \text{(Equation 2)},$$

where $EI_{second\ outer\ layer}$=the bending stiffness of the second outer layer.

In order to have a material that will bend according to a smooth continuous radius a second condition is required. The bending stiffness of the second outer layer needs to be lower than the bending stiffness of the first outer layer. When the smoothly bendable board is subject to bending, the second outer layer should deform inwards or fold between the peaks of the corrugated middle layer. The location of where a bending moment is applied will determine where the second outer layer first will start to bend or fold. If the bending stiffness of the second outer layer is too high in relation to the first outer layer, the material will not bend into a smooth continuous radius. A high bending stiffness of the second outer layer requires a high bending moment in order to bend/fold the second outer layer and hence the smoothly bendable board. When the second outer layer starts to bend/fold between two peaks of the flutes of the middle layer, i.e. having a high applied moment, the first outer layer will easily kink if its bending stiffness is not high enough, due to the sudden drop of bending stiffness of the second outer layer as the second outer layer folds. Once the first outer layer gets a kink, the material will not bend into a smooth continuous radius. If the second outer layer has been bent, i.e. folded, between two of the peaks of the corrugated middle layer, the difference with respect to the required moment between bending/folding the next section of the second outer layer and re-bending/folding the already bent section of the second outer layer, should be as small as possible.

Hence, the drop in bending stiffness of the second outer layer between two peaks after bending/folding should be as low as possible. In other words, the bending stiffness should be as low as possible. However, if the first outer layer has a higher bending stiffness, it would be possible to allow a higher bending stiffness of the second outer layer.

If all the sections of the second outer layer exhibit buckling and the bending stiffness of the first outer layer is high enough compared to the second outer layer, (as mentioned above) the smoothly bendable board will bend into a smooth and continuous radius. However, the different sections of the second outer layer will eventually get kinks as the bending radius decreases. These kinks will not affect the function of the material. However, if the second outer layer in some way will be exposed to consumers, it could be advantageous from a design perspective if there are no kinks. These kinks can be avoided with the following condition:

$$\sigma^*_{MAX} < SCT, \quad \text{(Equation 3)},$$

where $$\sigma^*_{MAX} = \frac{t}{2} \frac{E^*}{\left(\frac{\lambda}{16}\left(\frac{1}{\beta}\left(\frac{R_0}{R_0+T}\right)^2 + \beta\right)\right)}, \quad \text{(Equation 4)},$$

where $$E^* = E \cdot t,$$

$$\beta = \sqrt{\left(1 - \frac{R_0}{R_0+T}\right)},$$

E=Young's modulus, t=thickness of second outer layer, $R_0$=bending radius as measured to the second outer layer, T=thickness of the total board, i.e. the distance between the outer surface of the first outer layer and the outer surface of the second outer layer.

As both sides of the smoothly bendable board as used in a construction as disclosed have smooth surfaces, whereas the single faced corrugated board have fluting facing one side, the smoothly bendable board is less likely to get stuck in converting equipment.

Compared to single faced corrugated board, a smoothly bendable board as described herein is compatible with conventional converting machinery such as printing and die-cutting.

Other possible applications could be to use the built-in spring feature, as the material is returning to its original position after bending, to construct smart opening devices such as self opening packages.

Additionally, it is possible to obtain single curved shaped constructions and designs using the smoothly bendable board compared to ordinary corrugated board or carton board without having the material deform. This may be interesting in a packaging context as the possibility to make a curved form with a small radius might be attractive to consumers.

The smoothly bendable board may have a middle layer which is a corrugated layer including flutes. The smoothly bendable board may be outwardly bendable only in a direction towards which the second layer faces, where the direction is essentially perpendicular to the flutes of the middle layer.

The smoothly bendable board may have a bending stiffness of the second outer layer chosen such that each section of the second outer layer exhibits buckling according to the equation $$EI_{second\ outer\ layer} < \frac{SCT \cdot \lambda^2}{4\pi^2}.$$

The first and/or second outer layer may be made up of a material having a surface suitable for printing.

As mentioned earlier one application of the smoothly bendable board is to use it in a package construction. Having surfaces adapted for this simplifies production and handling.

The first outer layer may be made up of one of a liner board, paper or plastic or a laminate of any two or more of a liner, paper or plastic or a composite material. This applies where certain requirements regarding the various layers are fulfilled, as has been described above and as will be further described below.

These materials display the desired characteristics of bending stiffness for the first outer layer and are easily adaptable to suit the different requirements needed in order to vary the smoothly bendable board to different uses. For instance any kind of printable surface attachable either to the flutes directly or laminated on top of another surface attached to the flutes or another form of middle layer is conceivable. Depending on the characteristics (e.g. grammage) of carton board and the intended bending radius (examples of minimum radius of carton coard can be seen in Table 1 below), carton board grades can be used as the first outer layer.

The second outer layer may be made up of one of a liner board, paper or plastic or a laminate of any two or more of a liner, paper or plastic or a composite material, where certain requirements regarding the various layers are fulfilled.

The first outer layer and/or the second outer layer may be made up of one of a fine paper, supercalendered paper, machine-glazed paper, greaseproof paper, newsprint or machine-finished paper, liner, metal foil, metalized film or a composite material or a laminate of any two or more of a fine paper, supercalendered paper, machine-glazed paper, greaseproof paper, newsprint or machine-finished paper, liner board, metal foil, metalized film or a composite material such as cellulose fibre reinforced polymers (e.g. including nano-cellulose).

These materials display the desired characteristics of bending stiffness for the second outer layer and are easily adaptable to suit the different requirements needed in order to vary the smoothly bendable board to different uses.

The corrugated middle layer may include any of the flute sizes A, B, C, D, E, F, G or K or include some other suitable core material such as a thermoformed structured core, containing cavities. It could for example be a core material with cup-shaped imprints (punctual support). The thermoformed core may form a continuous middle layer or it may form a middle layer where the thermoformed core material is present intermittently between the first and second layers. The thermoformed core may for instance be made of plastics or a cellulose-based material. In the case of using a thermoformed core, the thermoformed core should be flexible in order to be able to follow the bending of the first and second outer layers. The corrugated middle layer may include any other flute size (besides the ones listed above) larger than E-flute.

Also described is a method for producing a package construction of the kind mentioned above. Consequently, a smoothly bendable board material could be provided which includes a middle layer, a first outer layer and a second outer layer.

Furthermore, the method may include the steps of: attaching the first outer layer to the middle layer, producing a single-face board; and attaching the second outer layer to the middle layer, wherein the second outer layer has a lower bending stiffness according to ISO 5628 than the first outer layer such that the smoothly bendable board is outwardly bendable only in a direction towards which the second layer faces.

Alternatively, the process may include attaching the second outer layer to the middle layer, producing a single-face board; and then attaching the first outer layer to the middle layer.

According to a further alternative method of manufacturing, the first and second outer layers could be added to the middle layer simultaneously.

The method can also include arranging the single-face board such that it is flat prior to attaching the second outer layer to the middle layer. This ensures that the smoothly bendable board does not bend in an undesired direction.

By using an initially curved single faced corrugated board in the direction of the corrugated middle layer, and arranging it to be flat before attaching the second outer layer; it is more difficult for the smoothly bendable board to spontaneously bend in the direction towards which the second layer faces. By using this production method, it is possible to add bending resistance (in the direction towards the second outer layer) to the material.

The method may also include:

- attaching the first outer layer to the middle layer, producing a single-face board;
- arranging the single-face corrugated board such that it is curved in a direction towards which the second layer faces; and
- attaching the second outer layer to the curved corrugated middle layer.

The result will be an initially curved material that is restricted from returning to a flat phase, but still further bendable towards the direction which the second layer faces and perpendicular to the flutes of the corrugated middle layer.

The method may be used when the middle layer of the smoothly bendable board is a corrugated layer including flutes or other suitable core material such as a thermoformed core. For the method described above, the second outer layer may be attached onto the middle layer before the first outer layer is attached onto the middle layer. The first outer layer and the second outer layer may also be attached simultaneously onto the middle layer. This means that the described material can be used in order to produce the package construction, said package construction having the advantages stated above.

BRIEF DESCRIPTION OF DRAWINGS

Embodiments of the invention will now be described with reference to certain embodiments and referring to the drawings; in which.

DETAILED DESCRIPTION OF EMBODIMENTS

In the following, certain embodiments are described, which are also shown in the appended drawings.

Figure 1A:
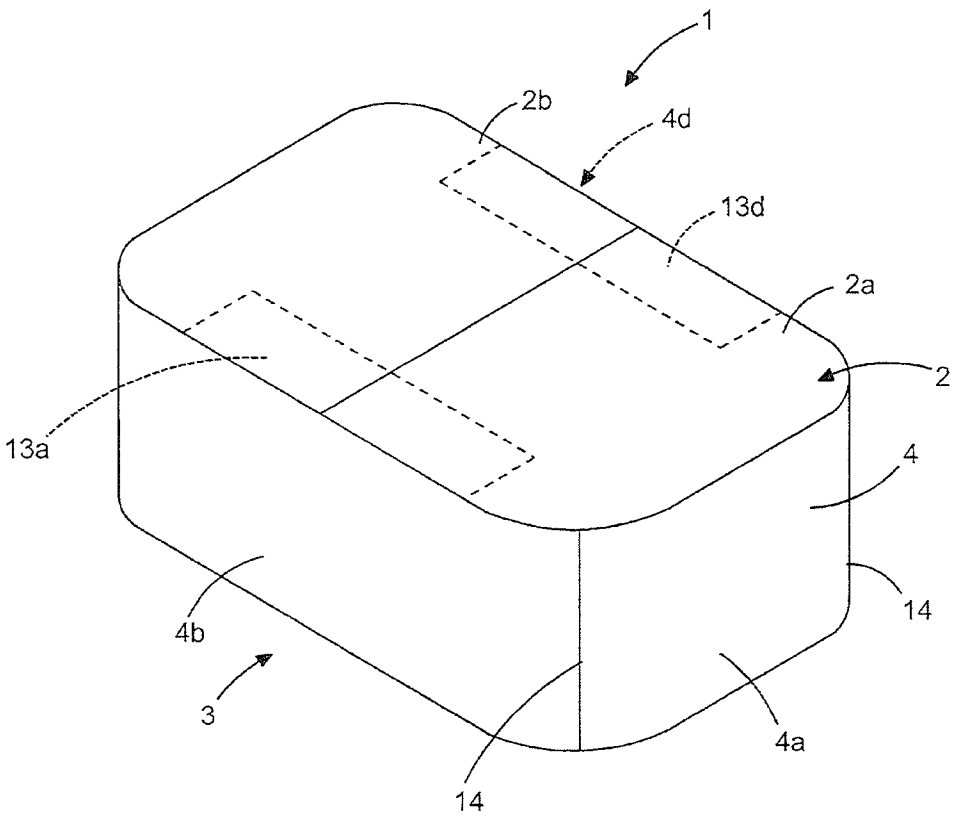
FIG. 1*a* shows a first embodiment of a packaging construction.

FIG. 1*a* schematically shows a packaging construction 1. Accordingly, the packaging construction 1 defines a top side 2, a bottom side 3 (not visible in FIG. 1*a*) and a side panel element 4 forming a plurality of side panels, of which two side panels 4*a*, 4*b* are visible in FIG. 1*a*. The side panels 4*a*, 4*b* extend from the bottom side 3 to the top side 2. In this manner, the packaging construction 1 can be said to form a closed structure enclosing an interior space. FIG. 1*a* shows the packaging construction 1 in its erected condition in which it has been (or is intended to be) filled with contents of some sort.

Figure 1B:
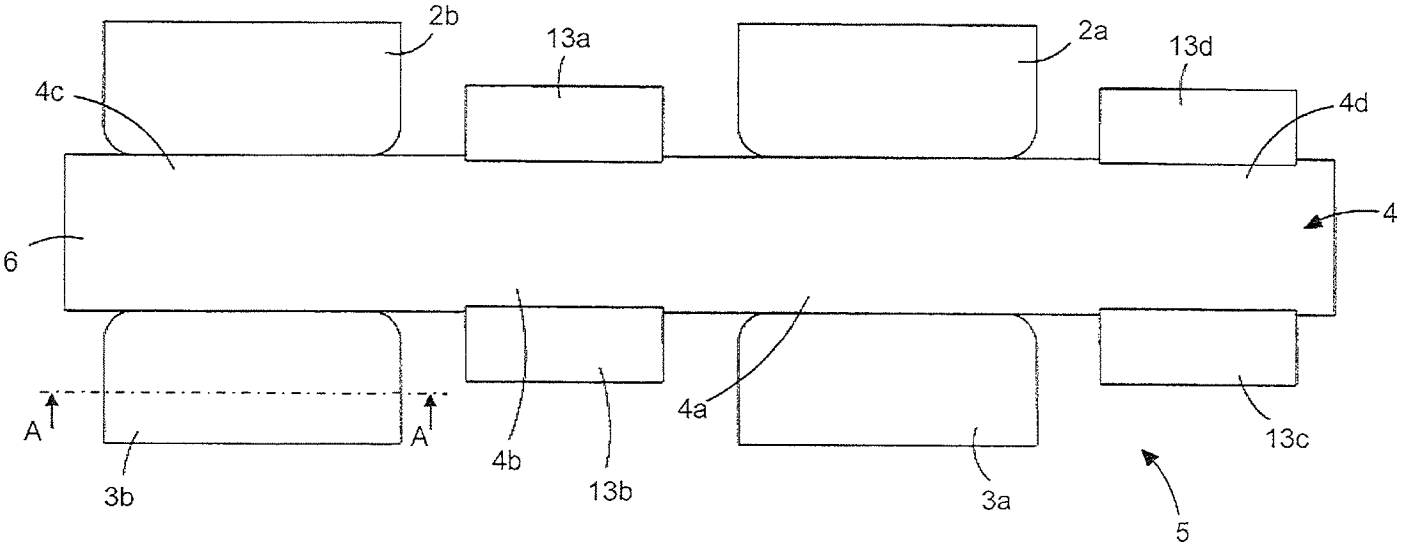
FIG. 1*b* shows a blank material being designed so as to constitute the original material for forming said packaging construction of FIG. 1*a;*

FIG. 1*b* schematically shows an original blank 5 being used for forming the packaging construction 1. The blank 5 is suitably formed so as to include two flaps 2*a*, 2*b* which can be folded so as to form the above-mentioned top side 2 when the construction 1 is in its assembled state. Also, the blank 5 includes two further flaps 3*a*, 3*b* which can be folded so as to form the above-mentioned bottom side 3 when the construction 1 is in its assembled state.

Consequently, in FIG. 1*b*, reference numeral 5 refers to the blank which constitutes the starting material for manufacturing the packaging construction 1. The blank 5 is made of a board material 6 which preferably is a multi-layer board material which will now be described as such with reference to FIGS. 2*a* and 2*b*.

Figure 2B:
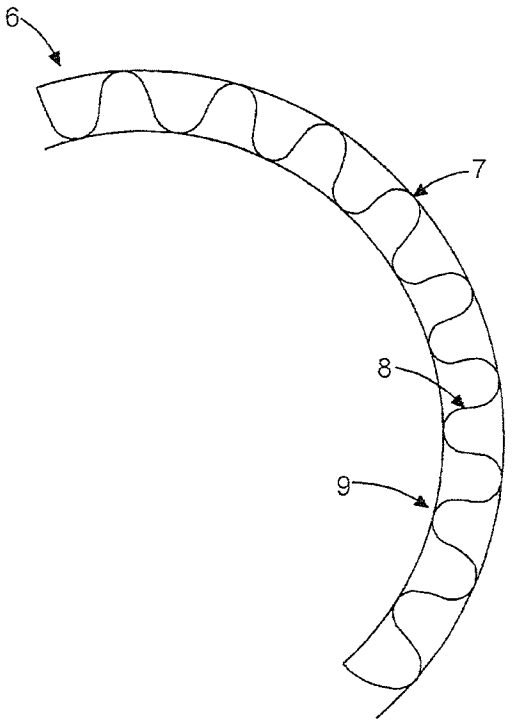
FIG. 2*b* schematically shows the board shown in FIG. 2*a* and being outwardly bent.
Figure 2A:
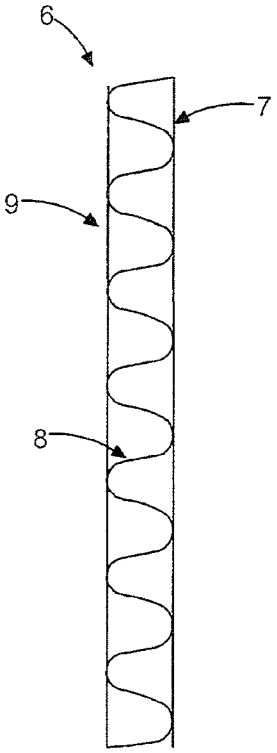
FIG. 2*a* schematically shows a smoothly bendable board material, said board being in a flat state.

FIG. 2*a* schematically discloses the board material 6, which in particular is in the form of a smoothly bendable board 6. More precisely, the smoothly bendable board 6 includes a first outer layer 7, a middle layer 8 and a second outer layer 9 made of a material with a lower bending stiffness than the first outer layer 7.

Although the smoothly bendable board in FIGS. 2*a* and 2*b* shows a corrugated middle layer 8, the invention is not limited to a packaging construction made from a board material having a middle layer 8 in the form of a corrugated layer. The following description also applies to a smoothly bendable board having a middle layer made up of for instance a thermoformed core. When the term "corrugated middle layer" is used it is conceivable to have a thermoformed core instead. The first outer layer 7 and the second outer layer 9 of the smoothly bendable board 6 may be either a single layer or a laminate of two or more layers having the above mentioned characteristics. The outer layers may also be coated or laminated together with another layer such as a film to achieve barriers properties such as barrier against moisture, water vapour, grease, aroma, oxygen, or migration of volatile substances such as components of mineral oil and free radical from UV ink or other volatile substances.

The corrugated middle layer 8 includes flutes may include a single layer of fluting or two or more layers of fluting where each layer may have the same flute size or different flute sizes.

The first outer layer 7 and the second outer layer 9 may have a surface suitable for printing as is known in the art.

FIG. 2*b* schematically shows the smoothly bendable board 6 in a form in which it is being outwardly bent (i.e. defining a convex form) in a direction towards which the second outer layer 9 faces and perpendicular to the flutes of the corrugated middle layer 8. The low bending stiffness of the second outer layer 9 in combination with the high bending stiffness of the first outer layer 7 makes this possible. The same characteristics make it difficult for the smoothly bendable board 6 to bend in the opposite direction without deforming one or more of the layers 7, 8 or 9.

The board 6 shown in FIG. 2*b* can be manufactured by applying a second outer layer 9 to a single face corrugated board. The second outer layer 9 is suitably applied to the single face corrugated board by means of starch glue, melt adhesive or any other kind of fastening means suitable for attaching a layer to a fluting layer. The fastening means may contain other functional components, for example in order to achieve barriers properties according to what has been mentioned earlier.

Alternatively, the board shown in FIGS. 2*a* and 2*b* may be manufactured by applying the first outer layer 7 to a single face board, which has been formed by attaching the second outer layer 9 to the middle layer 8. According to a further alternative, the first and second outer layers can be applied simultaneously to the middle layer 8 in order to produce said board.

The second outer layer 9 is generally applied while the single face corrugated board is placed flat on a surface. In order to ensure that the smoothly bendable board 6 stays flat it may be suitable to use an initially curved single faced corrugated board in the direction of the corrugated middle layer 8, and arrange it to be flat before attaching the second outer layer 9. It will then be more difficult for the smoothly bendable board 6 to spontaneously bend in the direction towards which the second layer faces. By using this production method, it is possible to add bending resistance (in the direction towards the second outer layer) to the material.

With regard to suitable materials, it can be noted that the material for the first outer layer 7 should have a bending stiffness which is sufficient as compared with the second outer layer 9. Paper or thin carton can be used as materials for the first outer layer 7. It is also possible to use plastic material or a laminate of different material layers, or a composite material. Generally, the materials used for the first outer layer 7 and the second outer layer 9 must be able to be formed in a curved or bent form without being damaged.

The adhesive, used to laminate the three components together, may be constituted by starch glue, hot melt glue, PVA (Polyvinyl acetate) glue or any other adhesive suitable for lamination. It is also possible use a modified starch glue. By adding various polymeric materials into the starch glue it is possible to give the glue a better resistance against moisture, which may be an advantage if the packaging construction will be used in wet environments or in environments where the moisture level is high.

It shall be possible to bend the smoothly bendable board 6 into a radius which corresponds to less than the minimum radius that standard corrugated board can be bent into. After bending of the smoothly bendable board 6 there shall be no creasing, i.e. folding of the first outer layer 7 of the board. The first outer layer 7 of the smoothly bendable board 6 becomes convex after bending. In FIG. 2*b*, the buckling of the second outer layer 9 is not present for illustrative reasons.

The middle layer 8 includes flutes and the board 6 is outwardly bendable only in a direction towards which the second outer layer 9 faces, wherein the direction is essentially perpendicular to the flutes of the middle layer 8, i.e. essentially perpendicular to an imaginary direction along which the flutes extend.

Figure 3:
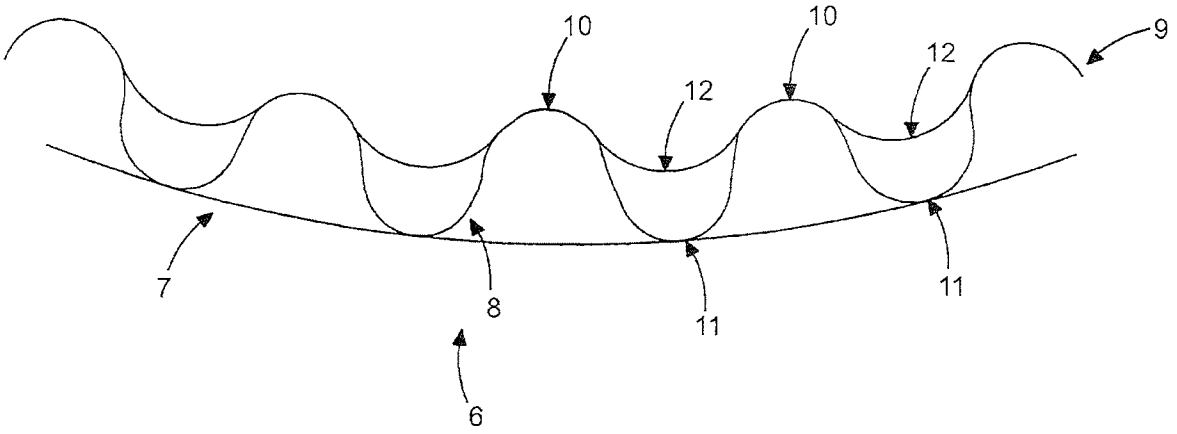
FIG. 3 schematically shows the concept of buckling or bending the board material according to FIGS. 2*a* and 2*b;*

The concept of buckling, or bending, of the smoothly bendable board material 6, is shown in FIG. 3, which shows a close up of the board 6 in FIG. 2*b*. In FIG. 3, the first outer layer displays a smooth and continuous radius without creasing. The corrugated middle layer 8 includes a number of peaks 10 facing the second outer layer 9 and a number of valleys 11 facing the first outer layer. Between the peaks 10, the second outer layer includes sections 12. One condition to get a smooth and continuous radius is that the second outer layer 9 should buckle between each peak 10 of the corrugated middle layer 8 when the material is subjected to bending in the bendable direction. When each section 12 of the second outer layer 9 exhibits buckling, the bending can be distributed across each section of the material. In FIG. 3, the size of the buckling of the second outer layer 9 is shown for illustrative purposes and may vary depending on for instance the degree of bending and the choice of materials.

When the smoothly bendable board 6 is exposed to bending, the material in the second outer layer 9 will start to buckle between the peaks 10 of the corrugated middle layer 8 if the bending stiffness of the second outer layer 9 is low enough. It is an important feature of the board 6 that the buckling of the second outer layer 9 is carried out in a controlled manner.

Suitably, the packaging construction 1 is arranged so that a rounded edge between two adjacent side panels (for example side panels 4*a*, 4*b* in FIG. 1*a*) has a radius which is approximately 5 mm or more. In particular, it has been found that particularly advantageous results as regards the BCT and stability in transit properties can be provided if the radius is approximately in the range of 10-150 mm. The optimum radius depends for example on the length of the side panels. It should however be noted that the invention is not limited to any particular radius, but other values of the radius are possible within the scope of the invention.

In order to test the minimum radius that the smoothly bendable board can be bent to without getting material damage, a special test rig has been developed. The test rig includes six pipes with a smooth surface having the diameters 102 mm, 75 mm, 34 mm, 33 mm, 20 mm and 12 mm. The pipes can be made of metal and are mounted onto a base such as a beam or a table for stability.

The width of the test pieces of all boards is 105 mm, i.e. the size of an A4 paper cut in two halves. The length of the test pieces is 297 mm, i.e. the length of an A4 paper. All test pieces are conditioned according to ISO 187 (pre-conditioned at 30% RH, 23 degrees C., and thereafter conditioned at 50% RH, 23 degrees C.).

A selected test piece is first bent around the largest pipe and thereafter visually inspected to detect any damages to the material. The test piece is bent 180°, i.e. such that both ends of the test piece point in the same direction. If no damage is visually detectable, the test piece is bent around the second largest pipe and evaluated in the same way. This procedure is repeated using a smaller pipe diameter until the material is damaged by the bending process or until the material successfully passes bending around the smallest 12 mm pipe. In addition to testing the different types of smoothly bendable corrugated board a selection of carton board grades is chosen. In addition to the PE-laminated corrugated board, the 483 E grade (E-flute used for outdoor displays, 610 g/m2 where the fluting is laminated onto liner+PE-layer+MG-paper) is tested.

Table 1 illustrates the result of the bending test. OK! means that no damage is seen visually. Fail! means that damage such as kinks is seen visually in any of the outer layers. A * before the grade indicates that the board was made as described above, i.e. with a single face material on which a further layer is attached as described with reference to FIGS. 2*a* and 2*b*.

TABLE 1

Smoothly bendable corrugated board and carton board tests for minimum bending radius, *indicates that the board is made according to an embodiment of the invention.

| Grade | Ø 102 mm | Ø 75 mm | Ø 43 mm | Ø 33 mm | Ø 20 mm | Ø 12 mm |
|---|---|---|---|---|---|---|
| *C-flute between EK 165 + News print 45 | OK! | OK! | OK! | OK! | OK! | OK! |
| *B-flute between EK 125 + News print 45 | OK! | OK! | OK! | OK! | OK! | OK! |
| *E-flute between EK 125 + News print 45 | OK! | OK! | OK! | OK! | OK! | OK! |
| *G-flute between EK 125 + News print 45 | OK! | OK! | OK! | OK! | OK! | OK! |
| MCK 600 WLC | OK! | OK! | FAIL! | | | |
| Kasur 300 GC1 | OK! | OK! | FAIL! | | | |
| MCK 450 GT4 | OK! | OK! | FAIL! | | | |
| Invercote Creato 240 | OK! | OK! | OK! | OK! | OK! | FAIL! |
| Invercote Duo 450 | OK! | OK! | OK! | FAIL! | | |
| Incada Exel 240 | OK! | OK! | FAIL! | | | |
| Eco-Print 300 GT3 | OK! | OK! | OK! | OK! | FAIL! | |
| 483E | FAIL! | | | | | |

As can be seen from table 1, all smoothly bendable boards which should be used for a packaging construction as described herein are able to bend according to a radius that is smaller than conventional boards without exhibiting visual damage to any of the outer layers. As can be seen in table 1 the 483 E grade fails already at the 102 diameter pipe.

Again with reference to FIGS. 1*a* and 1*b*, it can be noted that the package construction 1 is formed from a blank 5 being manufactured from the smoothly bendable board material 6 as described above with reference to FIGS. 2*a*, 2*b* and 3.

In particular, the side panel element 4 is formed so as to define four different side panels 4*a*, 4*b*, 4*c*, 4*d* (of which only two side panels 4*a*, 4*b* are visible in FIG. 1*a*) by bending the side panel element 4 and attaching its ends to one another, for example by means of gluing. Furthermore, the two top side flaps 2*a*, 2*b* are folded so as to form the top side 2, and the bottom side flaps 3*a*, 3*b* are folded so as to form the bottom side 3. Prior to the folding of the bottom side flaps 3*a*, 3*b* and the top side flaps 2*a*, 2*b*, a number of additional side panel flaps 13*a*, 13*b*, 13*c*, 13*d* are folded inwards into the inside of the packaging construction 1 in order to define support area on which the bottom side flaps 3*a*, 3*b* and the top side flaps 2*a*, 2*b* can be fastened. In this manner, the complete packaging construction 1 can be formed in a stable and strong manner.

With reference to FIGS. 2*a* and 2*b*, it is important to note that the embodiment shown in FIG. 1*a* is based on the principle that the second outer layer material 9 (cf. FIG. 2*b*) faces the interior of the finished packaging construction 1. This allows the construction 1 to be designed in a way with its rounded edges 14 as shown in FIG. 1*a*. In particular, an edge 14 forms a transition from one side panel to an adjacent side panel, for example from side panel 4*a* to side panel 4*b*. In this regard, the term "rounded edges" refers to edges which do not have any folds or similar interruptions of the curvature. Wash boarding marks on the first outer layer (i.e. marks which are indicating the peaks of the middle layer's fluting) are in this context not regarded as interruptions.

The package construction described herein may also be formed with a configuration where rounded edges between adjacent side panels or curved side panels are intentionally provided with irregularities, e.g. to provide a visual effect.

It should also be noted that the smoothly bendable board can be processed in various production equipment (e.g. die-cutting, printing, gluing, creasing and folding) in order to produce a packaging construction as described.

A second embodiment of the packaging construction will now be described with reference to FIGS. 4*a* and 4*b*. The packaging construction according to this second embodiment has a design which presents four side panels, of which only two side panels 4*a*', 4*b*' are visible in FIG. 4*a*. These side panels are designed with a bent form which can be said to be concave, i.e. its mid section closer towards the centre of the packaging construction 1" than its end sections. Furthermore, the package construction 1' has a top side 2' and a bottom side 3' (not visible in FIG. 4*a*).

The packaging construction according to the second embodiment is formed by the same board material 6 as described above and as shown in FIGS. 2*a*, 2*b* and 3. However, it should here be noted that, according to this second embodiment, the board material 6 is arranged so that the second outer layer 9 (cf. FIG. 2*b*) is arranged so that it faces outwards from the packaging construction 1", i.e. it faces towards the opposite direction as compared with the embodiment shown in FIGS. 1*a*, 1*b*.

Figure 4B:
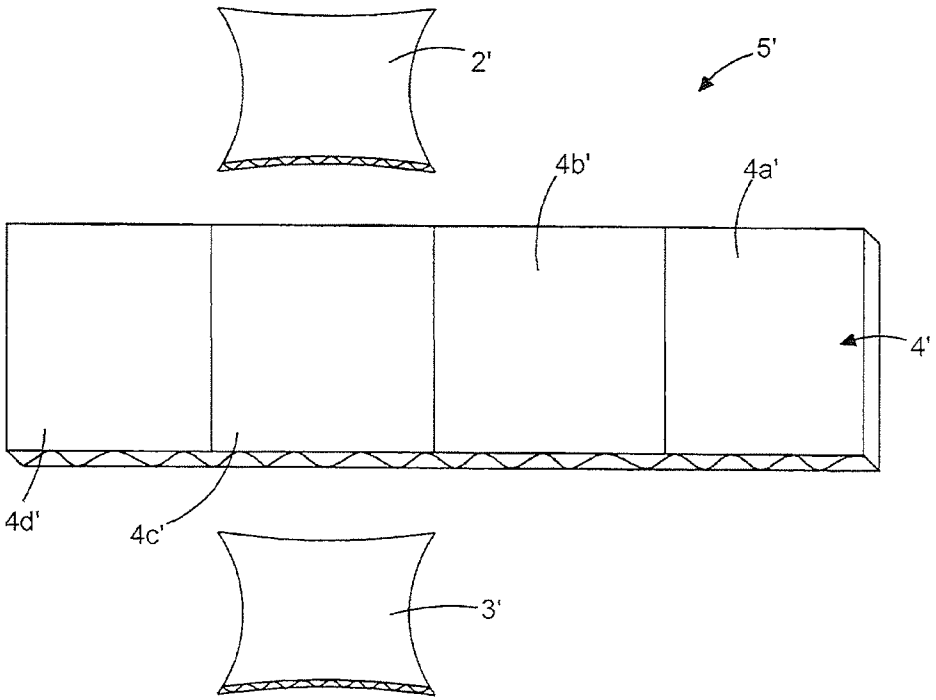
FIG. 4*b* shows a blank material being designed so as to constitute the original material for forming said packaging construction of FIG. 4*a;*
Figure 4A:
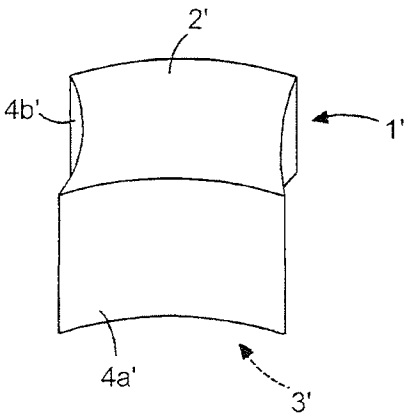
FIG. 4*a* shows a packaging construction in the form of a second embodiment.

FIG. 4*b* shows a blank 5' for the packaging construction 1' according to FIG. 4*a*. More precisely, the blank 5' is constituted by a side panel element 4' which is intended to be folded so as to form four side panels 4*a*', 4*b*', 4*c*', 4*d*', and a separate top side 2' and bottom side 3' which are intended to be fastened, suitably by gluing, to the side panel element 4'.

Figure 5B:
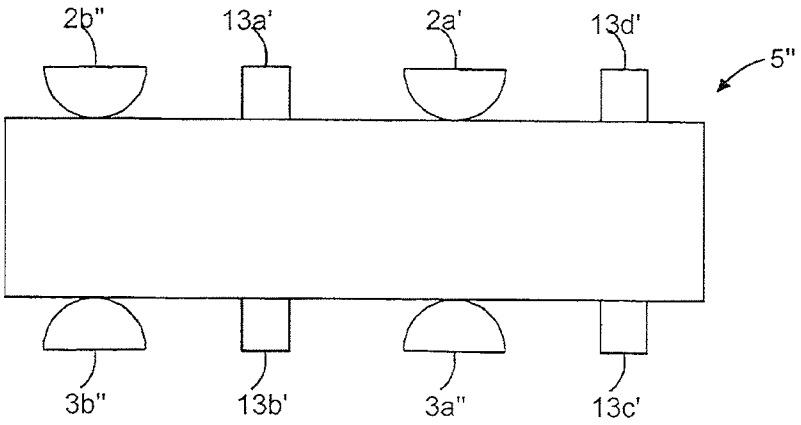
FIG. 5*b* shows a blank material being designed so as to constitute the original material for forming said packaging construction of FIG. 5*a;*
Figure 5A:
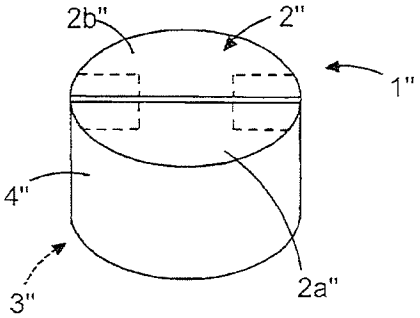
FIG. 5*a* shows a packaging construction in the form of a third embodiment.

A further embodiment is shown in FIGS. 5*a* and 5*b*. This embodiment corresponds to a package construction 1" which has a generally circular cross-sectional form in its erected, finished state. This means that it includes one single side panel element 4" which in itself defines a curved side panel surface. The package construction 1" also has a top side 2" and a bottom side 3" (not visible in FIG. 5*a*).

FIG. 5*b* shows a blank 5" which is used to form the package construction 1" shown in FIG. 5*a*. The blank 5" includes a side panel element 4", two top side flaps 2*a*", 2*b*", two bottom side flaps 3*a*", 3*b*" and corresponding side panel flaps 13*a*', 13*b*', 13*c*', 13*d*'. The package construction 1" shown in FIGS. 5*a* and 5*b* is manufactured from the board material as described above with reference to FIGS. 2*a*, 2*b* and 3.

Figure 6:
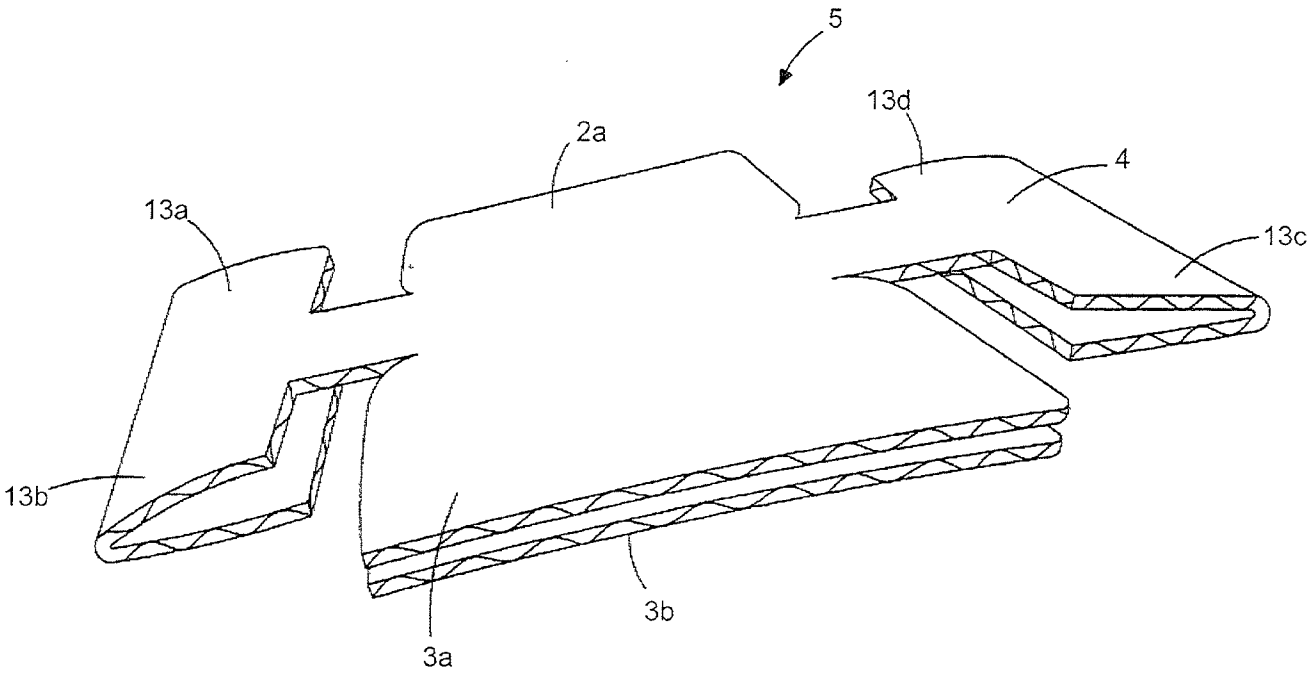
FIG. 6 shows a blank corresponding to the embodiment shown in FIGS. 1*a* and 1*b*, but in a flattened, i.e. collapsed, condition in which it is suitable to be transported.

A particular feature of embodiments of the packaging construction described herein is that it can be transported—after manufacturing of the original blank but before it is erected to be filled with suitable contents—in a folded, i.e. collapsed state. Such a condition of the original blank 5 is shown in FIG. 6, which is a perspective view of a blank 5 as shown in FIGS. 1*a* and 1*b*. As noted from FIG. 6, the side panel 4 has been folded so that its end section have been attached to one another, suitably by gluing. After that, the side panel flaps 13*a*, 13*b*, 13*c*, 13*d* (and corresponding sections of the side panel 4) have all been folded so that the entire blank 5 is in a flattened, collapsed state. In this condition, a large number of blanks 5 can be transported in an efficient manner. When the blanks have been transported to some type of production site in which they are to be filled with suitable contents, they are erected, filled with contents, and finally sealed so as form a finished package.

In particular, it should be noted that the folds which are formed in the side panel flaps 13*a*, 13*b*, 13*c*, 13*d* and the side panel 4 will be virtually invisible in the finished package construction 1 (cf. FIG. 1*a*).

Furthermore, as an example of how the BCT value is affected by introducing curved panels and or rounded edges between adjacent panels, BCT measurements of three different geometries are presented in Table 2. All tested geometries were conditioned according to ISO 187 (pre-conditioned at 30% RH, 23 degrees C., and thereafter conditioned at 50% RH, 23 degrees C.). In the test, the same amount of material and identical material (smoothly bendable board) was used for each geometry. Hence the perimeter for each geometry is kept constant (perimeter=880 mm). First, the shorter ends of one 900 mm×200 mm piece of smoothly bendable board (corrugated pipes pointing in the direction parallel to the shorter sides) was joined together by applying hot melt glue between a 20 mm material overlap. Thereafter, it was positioned into a horizontally placed, 6.5 mm deep corrugated board frame in order to shape the material into a construction with a desired shape. The different shapes of the frames were circular, square and square with rounded edges between adjacent sides. The radius of the rounded edges was 30 mm. In this test, the material was arranged so that said second outer layer (9) was facing the interior of said construction.

The result of this example shows (see Table 2 below) that the BCT value increased by about 35% by introducing rounded edges between adjacent edges and that the BCT value increased by about 80% by making a circular form compared with the square shaped geometry.

The material components in the smoothly bendable board was lwc 65 g/m$^2$ as second outer layer, white top liner 228 g/m$^2$ as the first outer layer and semi chemical fluting material 112 g/m$^2$ as the middle layer (b-flute). The thickness of the smoothly bendable board was 3 mm and the distance between corrugated pipes was 6.4 mm. The material was produced in a laminating machine where the first outer layer first was applied onto a corrugated middle layer using a standard process for making single faced corrugated material. In this process, the first outer layer and middle layer was web fed. Thereafter, the second outer layer was laminated onto the other side of the middle layer sheet by sheet.

TABLE 2

| Geometry | Square | Square rounded edges r = 30 mm | Circular |
|---|---|---|---|
| Perimeter (cm) | 88 | 88 | 88 |
| BCT (kN) | 2.8 | 3.8 | 5.0 |

To give another example of how the BCT value is affect by introducing curved panels, BCT measurements of a symmetrical diamond shaped geometry and a reference square shaped geometry is presented in Table 3 below. The same amount of material and identical material (smoothly bendable board) as for the previous tests was used in this test. In this case also, the perimeter is kept constant. First, a 900 mm×200 piece of smoothly bendable board ((corrugated pipes pointing in the direction parallel to the shorter sides) was given crease marks (parallel to the direction of the corrugated pipes) onto the first outer layer in order to mark the corners of the symmetrically shaped diamond shape. Secondly, the shorter ends of the 900×200 piece of smoothly bendable board was joined together, by applying hot melt glue between a 20 mm material overlap, into a panel. Thereafter, the panel was held in a standing position and positioned into a horizontally placed 6.5 mm deep corrugated board frame in order to shape the material into the diamond shape. The radius of the curvature for each concave side panel was 610 mm. The reference square shaped geometry was also given crease marks to form the corners.

The material used in this test was arranged so that the first outer layer was facing the interior of said construction. The result from this test showed that the BCT value increased by 33% compared to the square shaped reference geometry.

TABLE 3

| Geometry | Diamond | Square |
|---|---|---|
| Perimeter (cm) | 88 | 88 |
| BCT (kN) | 3.8 | 2.9 |

To give an example of a possible difference in bending stiffness between the first outer layer and second outer layer, the material used in the example above had a first outer layer with a bending stiffness of 8.7 mNm and a second outer layer with a bending stiffness of 0.13 mNm).

According to a further example, and regarding the material's production process, the second outer layer of the smoothly bendable board used in the tests described above were already cut into a sheet when applied onto the middle layer. Table 4 below presents the results from a second test, using smoothly bendable board produced by applying the second outer layer in a web fed process, running at normal production speed in a corrugating machine (160 m/min). Hence, it has been tested that the material can be produced in a regular manufacturing process at relatively high speed. In this test, lwc 65 g/m$^2$ was used as the second outer layer, white top liner, 200 g/m$^2$ was used as the first outer layer and semi chemical fluting 127 g/m$^2$ was used as the middle layer. The thickness of the this smoothly bendable board was 2.5 mm and the distance between corrugated pipes was 4.5 mm. The result showed the BCT value of the construction increased by 133% comparing the circular geometry with the square geometry. In this test, the material was arranged so that the second outer layer was facing the interior of said construction.

TABLE 4

| Geometry | Circle | Square |
|---|---|---|
| Perimeter (cm) | 88 | 88 |
| BCT (kN) | 5.2 | 2.2 |

Figure 7:
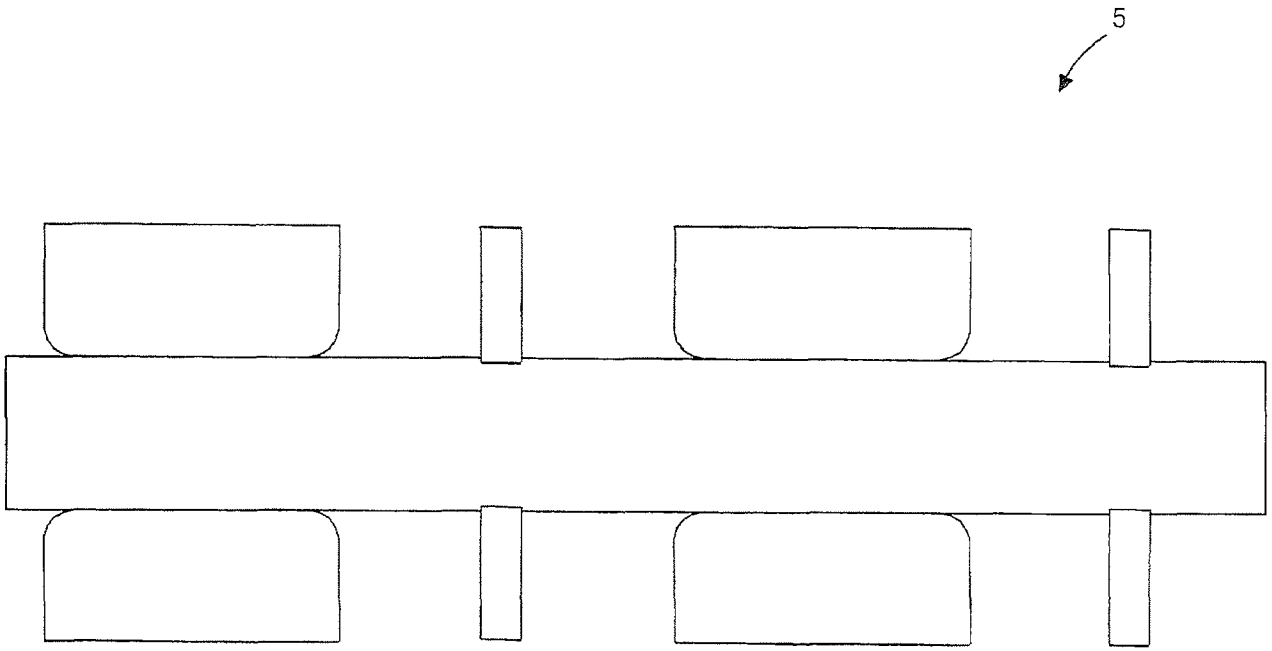
FIG. 7 shows a blank which can be used for so-called dynamic impact testing, as will be described below.

Dynamic impact testing of square shaped package (side length=220 mm, height=100 mm) comparing the standard 0201 box (box in accordance with the FEFCO code (FEFCO: Federation of Corrugated Board Manufacturers)) with a box having rounded edges between adjacent sides (according to FIG. 7, showing a blank 5 which generally corresponds to FIG. 1*a* but which has dimensions according to the above-mentioned 0201 box) was made according to the method described in patent application PCT/EP2011/073964. The results showed that the box having rounded edges (r=30 mm) could take about 80% more top load before the packaging construction got damaged. The distribution of loads was made according to Table 5.

TABLE 5

The letter in the sample name indicates if the same sample was used for one of several impact (e.g. sample No. 4 of design Rlb was tested 4 times).-
Reference signs mentioned in the claims should not be seen as limiting the extent of the matter protected by the claims, and their sole function is to make claims easier to understand.

| Design | Sample | Load (from top to bottom) | (kg) | Pass/No Pass |
|---|---|---|---|---|
| 0201 | 14 | 2 + 2 + 10 + 0 + 10 | 46 | No pass |
| 0201 | 15A | 2 + 0 + 10 + 0 + 10 | 44 | Pass |
| 0201 | 15A | 2 + 2 + 10 + 0 + 10 | 46 | No pass |
| 0201 | 16A | 2 + 2 + 10 + 0 + 10 | 46 | Pass |
| 0201 | 16B | 2 + 2 + 10 + 0 + 10 | 46 | Pass |
| 0201 | 16C | 2 + 2 + 10 + 2 + 10 | 48 | No pass |
| 0201 | 17A | 2 + 2 + 10 + 2 + 10 | 48 | Pass |
| 0201 | 17B | 4 + 2 + 10 + 2 + 10 | 50 | No pass |
| 0201 | 18A | 4 + 2 + 10 + 2 + 10 | 50 | Pass |
| 0201 | 18B | 4 + 2 + 10 + 2 + 10 | 50 | Pass |
| 0201 | 19A | 4 + 2 + 10 + 2 + 10 | 50 | Pass |
| 0201 | 19B | 4 + 2 + 10 + 2 + 10 | 50 | No pass |
| 0201 | 20 | 4 + 4 + 10 + 2 + 10 | 52 | No pass |
| 0201 | 21 | 4 + 2 + 10 + 2 + 10 | 50 | No pass |
| R1b | 4B | 8 + 8.5 + 10 + 8.5 + 10 | 67 | Pass |
| R1b | 4C | 10 + 8.5 + 10 + 8.5 + 10 | 69 | Pass |
| R1b | 4D | 10 + 10 + 10 + 8.5 + 10 | 70.5 | Pass |
| R1b | 4E | 10 + 10 + 10 + 10 + 10 | 72 | Pass |
| R1b | 6A | 12 + 10 + 10 + 10 + 10 | 74 | Pass |
| R1b | 6B | 12 + 12 + 10 + 10 + 10 | 76 | Pass |
| R1b | 6C | 12 + 12 + 12 + 10 + 10 | 78 | Pass |
| R1b | 6D | 12 + 12 + 12 + 12 + 10 | 80 | No pass |
| R1b | 6E | 12 + 12 + 12 + 12 + 12 | 82 | No pass |
| R1b | 7A | 12 + 12 + 12 + 12 + 10 | 80 | Pass |
| R1b | N7B | 12 + 12 + 12 + 12 + 12 | 82 | Pass |
| R1b | 7C | 14 + 12 + 12 + 12 + 12 | 84 | Pass |
| R1b | 7D | 14 + 14 + 12 + 12 + 12 | 86 | No pass |
| R1b | 8A | 14 + 14 + 12 + 12 + 12 | 86 | No pass |

Furthermore, the invention is not limited to any particular form or shape of the packaging construction or its parts. For example, the side panels can be arranged so as to form a square, rectangular or triangular form, or any other form involving a number of side panels. Also, in the case that only one side panel is used, a circular, oval, drop-shaped or half-moon shaped construction can be provided, or in fact generally any design involving a side panels the ends of which are joined to form a closed structure.

As will be realised, the invention is capable of modification in various obvious respects, all without departing from the scope of the appended claims. Accordingly, the drawings and the description thereto are to be regarded as illustrative in nature, and not restrictive.

The invention claimed is:

1. A packaging construction comprising multi-layer board material comprising a middle layer, a first outer layer attached to the middle layer and a second outer layer attached to the middle layer, said packaging construction defining a bottom side, a top side, and a plurality of side panels formed by the multi-layer board joining said bottom side and said top side so as to form a closed structure, wherein at least one edge is defined between adjacent side panels, wherein said packaging construction is formed with at least one side panel being curved and/or at least one edge being rounded, wherein the second outer layer has a lower bending stiffness according to ISO 5628 than the first outer layer for enabling bending of said board material according to a smooth continuous radius, wherein the first outer layer of the at least one curved panel and/or rounded edge displays a smooth and continuous radius without creasing and said second outer layer of the at least one curved panel and/or rounded edge is buckled by the bending, while portions of the first outer layer and the second outer layer that are not bent to form at least one curved panel and/or rounded edge, and wherein the bending stiffness of the second outer layer is defined by the equation:

$$EI_{second\ outer\ layer} < \frac{SCT \cdot \lambda^2}{4\pi^2},$$

where $EI_{second\ outer\ layer}$ is the bending stiffness of the second outer layer, SCT is the second outer layer's compression strength according to the short-span compressive test according to ISO 9895, and λ is the length between two peaks of the flutes of the middle layer of smoothly bendable board.

2. A packaging construction comprising multi-layer board material comprising a middle layer, a first outer layer attached to the middle layer and a second outer layer attached to the middle layer, said packaging construction defining a bottom side, a top side, and one side panel formed by the multi-layer board material joining said bottom side and said top side so as to form a closed structure, wherein said side panel forms a generally circular or oval shape, wherein said packaging construction is formed with said, side panel being curved, wherein the second outer layer has a lower bending stiffness according to ISO 5628 than the first outer layer for enabling bending of said board material according to a smooth continuous radius, wherein the first outer layer of the side panel displays a smooth and continuous radius without creasing and said second outer layer of the side panel is buckled by the bending, while portions of the first outer layer and the second outer layer that are not bent to form the side panel, and wherein the bending stiffness of the second outer layer is defined by the equation:

$$EI_{second\ outer\ layer} < \frac{SCT \cdot \lambda^2}{4\pi^2},$$

where $EI_{second\ outer\ layer}$ is the bendin stiffness of the second outer layer, SCT is the second outer layer's compression strength according to the short-span compressive test according to ISO 9895, and λ is the length between two peaks of the flutes of the middle layer of smoothly bendable board.

3. The packaging construction according to claim 1, wherein said board material is arranged so that said second outer layer faces the interior of said construction in its finished state.

4. The packaging construction according to claim 1, wherein said board material is arranged so that said second outer layer faces outwardly of said construction in its finished state.

5. The packaging construction according to claim 1, wherein the middle layer is corrugated.

6. The packaging construction according to claim 5, the middle layer comprises flutes and the board is outwardly bendable only in a direction towards which the second layer faces, wherein the direction is essentially perpendicular to the flutes of the middle layer.

7. The packaging construction according to claim 5, wherein the corrugated middle layer comprises any of the flute sizes A, B, C, D, E, F, G or K.

8. The packaging construction according to claim 5, wherein the corrugated middle layer comprises a combination of any of the flute sizes A, B, C, D, E, F, G or K.

9. The packaging construction according to claim 1, wherein said rounded edge has a radius which is 5 mm or more.

10. The packaging construction according to claim 9, wherein said rounded edge has a radius which is between 10-150 mm.

11. The packaging construction according to claim 1, wherein the first outer layer and/or the second outer layer is made up of a material having a surface suitable for printing.

12. The packaging construction according to claim 1, wherein the first outer layer is made up of one of a liner board, paper or plastic or a laminate, composite of any two or more of a liner, paper or plastic film, composite.

13. The packaging construction according to claim 1, wherein the second outer layer is made up of one of a liner board, paper, or plastic or a laminate, or a composite of any two or more of a liner, paper or plastic film.

14. The packaging construction according to claim 1, wherein the first outer layer is made up of one of a fine paper, supercalendered paper, machine-glazed paper, greaseproof paper, newsprint or machine-finished paper, liner, metal foil, metalized film, a composite material or a laminate of any two or more of fine paper, supercalendered paper, machine-glazed paper, greaseproof paper, newsprint or machine-finished paper, liner, metal foil, metalized film, carton board or a composite material.

15. The packaging construction according to claim 1, wherein the second outer layer is made up of one of a fine paper, supercalendered paper, machine-glazed paper, greaseproof paper, newsprint or machine-finished paper, liner board, metal foil, metalized film, a composite material or a laminate of any two or more of fine paper, supercalendered paper, machine-glazed paper, greaseproof paper, newsprint or machine-finished paper, liner, metal foil, metalized film or a composite material.

16. The packaging construction according to claim 1, wherein said packaging construction has a box compression test (BCT) value which is at least 15% higher compared to a square shaped box that has the same material specifications and uses the same amount of material, as measured according to IS012048.

17. The packaging construction according to claim 1, wherein said packaging construction will take at least 20% more top load before the material will be damaged in dynamic impact testing than a standard 0201 box in accordance with the FEFCO code (FEFCO: Federation of Corrugated Board Manufacturers) and having the same material specifications and using the same amount of material as said packaging construction.

18. The packaging construction according to claim 1, wherein the packaging construction is arranged for being folded and shipped substantially flat.

19. A method for producing the packaging construction according to claim 1, wherein the method comprises the steps of:

attaching the first outer layer to the middle layer, producing a single-face board;

attaching the second outer layer to the middle layer, wherein the second outer layer has a lower bending stiffness according to ISO 5628 than the first outer layer for enabling bending of said board material according to a smooth continuous radius; and forming the packaging construction to have at least one curved side panel and/or at least one rounded edge, wherein the first outer layer of the at least one curved panel and/or rounded edge displays a smooth and continuous radius without creasing and said second outer layer of the at least one curved panel and/or rounded edge is buckled by the bending, while portions of the first outer layer and the second outer layer that are not bent to form at least one curved panel and/or rounded edge have smooth surfaces.

20. The method according to claim 19, wherein the single-face board is curved in the direction towards which the first outer layer faces, and arranging the initially curved single faced board to be flat before attaching the second outer layer.

21. The method according to claim 19, wherein the middle layer is a corrugated layer comprising flutes.

22. A method for producing the packaging construction according to claim 1, wherein method comprises the steps of:

attaching the second outer layer to the middle layer, producing a single-face board;

attaching the first outer layer to the middle layer, wherein the second outer layer has a lower bending stiffness according to ISO 5628 than the first outer layer for enabling bending of said board material according to a smooth continuous radius; and forming the packaging construction to have at least one curved side panel and/or at least one rounded edge, wherein the first outer layer of the at least one curved panel and/or rounded edge displays a smooth and continuous radius without creasing and said second outer layer of the at least one curved panel and/or rounded edge is buckled by the bending, while portions of the first outer layer and the second outer layer that are not bent to form at least one curved panel and/or rounded edge have smooth surfaces.

23. The method according to claim 22, wherein the single-face board is arranged such that it is curved in a direction towards which the second outer layer faces; and then attaching the second outer layer to the curved middle layer.

* * * * *